United States Patent [19]

Frianeza-Kullberg et al.

[11] Patent Number: 4,781,756

[45] Date of Patent: Nov. 1, 1988

[54] REMOVAL OF LITHIUM NITRIDE FROM LITHIUM METAL

[75] Inventors: Teresita C. Frianeza-Kullberg; Dennis J. Salmon, both of Gastonia, N.C.

[73] Assignee: Lithium Corporation of America, Gastonia, N.C.

[21] Appl. No.: 68,871

[22] Filed: Jul. 2, 1987

[51] Int. Cl.[4] ..... C22B 26/12; C22C 24/00; C22C 3/00

[52] U.S. Cl. ..... 75/66

[58] Field of Search ..... 75/66; 420/528

[56] References Cited

U.S. PATENT DOCUMENTS 3,957,532 5/1976 Settle et al. ..... 420/528
4,248,630 2/1981 Balmuth ..... 420/528
4,528,032 7/1985 Keough et al. ..... 75/66
4,556,535 12/1985 Bowman et al. ..... 420/528

*Primary Examiner*—Melvyn J. Andrews
*Assistant Examiner*—David Schumaker
*Attorney, Agent, or Firm*—Charles C. Fellows; Eugene G. Seems

[57] ABSTRACT

A process for the removal of lithium nitride from lithium metal by adding to liquid lithium metal containing lithium nitride, at a temperature between the melting point of lithium and 300° C., with agitation, a stochiometric quantity of aluminum to react with the lithium nitride, in an inert, nitrogen free atmosphere, continuing the agitation for at least one hour to form aluminum nitride and separating the aluminum nitride from the liquid lithium metal.

8 Claims, No Drawings

REMOVAL OF LITHIUM NITRIDE FROM LITHIUM METAL

This invention concerns an improved process for removing lithium nitride from high purity lithium metal.

High purity lithium metal is made by the conventional electrolytic decomposition of lithium chloride. In the case of making high purity lithium metal, the usual metal contaminants in lithium chloride are removed by conventional techniques such as solvent extraction, precipitation and crystallization techniques and using ion exchange processes to remove sodium, calcium and other metal contaminants to produce a very pure lithium chloride. However, the electrolytic cells during lithium metal production and ordinary handling of lithium metal during fabrication into batteries and other lithium devices always expose lithium metal to nitrogen in the air. Since lithium metal is very reactive, small amounts of lithium nitride are formed in most lithium metal during its production and increased exposure to nitrogen occurs especially in lithium metal scrap due to its exposure to atmospheric nitrogen.

The lithium battery industry requires very low levels of lithium nitride in battery grade lithium metal. Lithium nitride is a quality problem in producing battery and alloy grade lithium metal. Lithium nitride is objectionable in battery grade lithium metal as it tends to cause voids in the metal and the very hard lithium nitride particles scratch, score or pit extrusion dies, rollers and other metal finishing surfaces. The voids and irregularities in the lithium metal foil are objectionable and result in poor or irregular battery performance. While current commercial standards are set at 300 parts per million, expressed as nitrogen, as little lithium nitride as possible is very desirable in battery grade lithium metal.

One way to produce low nitrogen lithium metal would be to employ a process which excludes air during the electrolysis of lithium chloride brine to make lithium metal. Another option would be to add excess aluminum to the electrolytic cells and/or start with a lithium chloride brine containing excess aluminum thus precipitating aluminum nitride in the electrolytic cells. The difficulty with these processes is they would require specially designed electrolytic cells and a method of handling liquid lithium which would exclude nitrogen.

Several metals, zirconium and titanium, have been proposed as candidates for removal of nitrogen from lithium. These so-called "soluble getters" unfortunately require temperatures as high 800° C. which is an undesirable practical processing temperature.

U.S. Pat. No. 4,528,032 of the United States Department of Energy, described the addition of stoichiometric amounts of nitrogen to a liquid lithium metal used in cooling a fusion reactor. The lithium contained excess aluminum which reacted with the nitrogen and precipitated as aluminum nitride. The patent discloses that optionally aluminum may be added to liquid aluminum metal to remove nitrogen contained as dissolved nitrogen. The fusion process employs liquid lithium as a coolant in a closed loop at temperatures exceeding 800° F. (425° C.) see for example *Scientific American*, June 1971, Vol. 24, No. 6, pages 21 through 33, especially the diagram on page 30 and the text in the right-hand column of page 31. The process described in the Department of Energy publication is exemplified only by introduction of nitrogen into the closed cooling loop in a fusion type atomic reactor filled with molten lithium containing dissolved aluminum.

Excess aluminum is generally undesirable in solid lithium metal because aluminum causes an unwanted hardness increase in the lithium metal. These harder metals are more difficult to extrude, increase abrasion in extruders, rollers, etc., and otherwise raise processing costs. Lithium metal may be heated to soften it and make it easier to extrude but this increases the reactivity of the lithium which is undesired. In any event, U.S. Pat. No. 4,528,032 does not provide any useful information or practical processing times, mixing times, or procedures, temperature ranges or a method for adding aluminum to liquid lithium metal. A useful practical process for use by current lithium metal producers using electrolytic cells open to the atmosphere is desired and currently unavailable.

The present invention provides a practical process for the removal of lithium nitride from liquid lithium metal. The metal must be in the liquid state; when starting with scrap or other solid lithium, the metal is first melted. A stoichiometric amount of aluminum is added to the liquid lithium metal to react with lithium nitride in the liquid lithium, using a temperature between the melting point of lithium (about 181° C.) and about 300° C. while agitating the metal for 1 hour to 24 hours or longer to permit the aluminum to react with lithium nitride and separating the aluminum nitride from the liquid lithium metal. The process is conducted in the substantial absence of nitrogen and preferably in a rare gas inert atmosphere.

The applicants prefer to remove lithium nitride from lithium metal in a device termed a "remelter" which is a heated melting pot in which large production size lithium metal ingots are remelted for alloying purposes, casting into smaller ingots for special uses and so forth. Such a remelter was equipped with a single agitation-dip tube for introducing an argon sparge to provide agitation and exclude air; this device was evaluated for removing nitrogen from high nitrogen content lithium metal. Any device inert to liquid lithium with suitable means for heating the metal to its melting point and above, agitation means and designed to exclude nitrogen would be suitable for practicing this invention.

It was recognized that contacting a small amount of lithium nitride in a relatively large amount of liquid lithium with a small amount of higher melting aluminum (melting point 660° C.) in a remelter which ordinarily melts lithium metal (melting point 180.6° C.) and only utilized temperatures of up to 300° C. would be a problem. The prior art, while suggesting adding aluminum to liquid lithium contains no example teaching how to effect contact between a small amount of the contaminating lithium nitride and a small amount of the reactant aluminum other than to add it to liquid lithium in a closed fusion reactor cooling loop.

The Applicants found that it was unnecessary to attain aluminum melting temperatures in order to react the aluminum with the lithium nitride. However, adding finely ground and powdered aluminum to argon agitated liquid lithium would be expected to reduce the time taken to react, but such finely ground aluminum is known to be pyrophoric so no attempts to use such materials were made. When using granular aluminum it was found that care had to be taken to ensure good contact with the lithium metal. Granular size aluminum was carefully introduced into the liquid lithium and extensive agitation by argon gas was necessary to react the aluminum with the lithium nitride in the liquid metal. Granular or pebble size aluminum, 2 to 10 millimeter, was found to take up to 24 hours to contact and react with the small amounts of lithium nitride in the liquid lithium. Moreover, additional time was required after the reaction was completed and the agitation terminated to permit the aluminum nitride to settle out of the lithium metal. The aluminum nitride was separated from the lithium metal by settling and the use of a 0.5 μm filter.

Although the 24 hour processing period was considered an acceptable period, in order to decrease this period, the applicants evaluated adding aluminum to liquid lithium in the form of a lithium-aluminum alloy in which solid alloy the aluminum was in solution in the lithium. Surprisingly, this reduced the purification time to only 1 to 4 hours in the remelter-reactor thus making the process a commercial success. Preferred alloys for use in this aspect of the invention are those alloys that melt at or below the operating temperature of the remelter-reactor. Higher melting lithium-aluminum alloys can be employed but longer time periods are required because it takes longer to dissolve the higher melting alloys, i.e. those that melt at temperatures above the reactor temperature. The lower melting alloys that melt in the reactor result in shorter processing cycles as the aluminum goes into solution quickly and is available to quickly react with the nitride. Such alloys may be added to liquid lithium or may be melted together with high nitride scrap lithium or metal. The alloys may be in the form of pieces, extruded wire or ribbon, granular or whatever form is convenient and contain up to 9 wt % aluminum.

Another way to contact aluminum lithium alloys with the lithium nitride in liquid lithium may be to use an alloy whose melting point is above the melting point of the liquid lithium. Such alloys could be fabricated into sheets and inserted in the remelter where the agitated liquid lithium contacts the aluminum and the reaction with lithium nitride occurs. Sintered alloys (20% Li 80% Al) are commercially available and they are porous. These alloys could be used in the manner of the sheets described above or the liquid lithium can be filtered through such an alloy to both filter the lithium metal and react the lithium nitride with aluminum to form aluminum nitride which would be immediately removed from the liquid lithium by the reactive filter made of an aluminum-lithium alloy. A sintered aluminum filter containing little or no lithium could be utilized.

The preferred nitrogen free atmosphere for conducting this reaction is a rare gas atmosphere.

The following experiments further illustrate the invention.

The remelter-reactor was equipped with a heating means and a dip-tube which reached the bottom of the pot for effecting agitation, and if desired for introducing the granular aluminum. A ½ micron filter was also equipped in the pot to filter the metal. High nitrogen (>300 ppm) lithium metal was loaded into the remelt pot. The metal was melted under argon. Temperature was maintained at 225°-245° C. Agitation of the metal with argon was done for about 24 hours, after which the aluminum nitride was allowed to settle. A 4-inch diameter ingot, about 5.1 pounds, was then cast. Initial N, Al, and Ca analyses were taken from this sample ingot.

Different molar ratios of Al/N were tested. The calculated amount of aluminum in the form of 2-10 mm granules (Johnson Matthey, Inc., 99.95%) was added to the pot. Agitation was done by argon for 24 hours. Settling times were generally 24 hours. Several four-inch diameter ingots were cast, and the final concentrations of N, Al, and Ca were determined.

The data obtained from the use of aluminum as a getter for nitrogen in lithium metal is listed in Table 1. Initial tests (Nos. 1 and 2) where excess aluminum was added (molar ratio Al/N=4) indicated that 94-96% N removal can be achieved.

In Experiment Nos. 4-6 the molar ratio of Al/N was varied from 0.5 to 1.0. The results showed that Al reacted in a 1:1 fashion with nitrogen to form AlN, not $Li_3AlN_2$. Residual aluminum varied from 6-10 ppm; initial Al was 6 ppm. This indicates completeness of reaction. Calcium was initially 110 ppm; final Ca was 46-62 ppm. This decrease in Ca indicates that some calcium settled down as sludge in the pot.

Using granular aluminum as the aluminum source, a few tests were conducted to determine the agitation time required for completeness of reaction. Agitation times were varied while settling times were kept at 24 hours, and a stoichiometric Al/N ratio was maintained.

EXPERIMENT 7

Five hundred nine pounds of lithium metal containing 900 ppm nitrogen were treated with a stochiometric amount of aluminum. Aluminum granules (404.9 grams) were added to the melted lithium metal contained in the remelter maintained at 225°-245° C. Agitation was done with argon through the dip-tube. After 3 hours of agitation, the nitride was allowed to settle for 24 hours prior to casting. Analyses of the 4-inch diameter ingots showed negligible nitride removal (about 2%). The agitation was resumed and continued for an additional 6 hours (total of 9 hours) after which additional ingots were cast. Analyses of these ingots indicated about 53% nitride removal.

At least 24 hours of agitation by argon seems to be necessary for completeness of reaction. Some design modification may be necessary in order to have better stirring. For example, several agitation dip tubes may be added in the tank. It was also observed in a control test that no nitrogen reduction is achieved by agitation under argon alone in the absence of added aluminum.

Purification of lithium metal by nitride removal using aluminum proceeds in the manner shown:

$$Li_3N + Al \rightarrow AlN\ (\downarrow) + 3\ Li$$

The data obtained show that a stoichiometric reaction, forming AlN, takes place. Nitrogen in the lithium metal can be reduced by aluminum from levels of >300 ppm to ~20 ppm with very little residual aluminum.

Experiments 8 to 11

The following additional experiments were conducted in which lithium metal containing known amounts of dissolved aluminum was melted together with lithium metal with high levels of lithium nitride with argon agitation for one to two hours.

8. Lithium metal alloy (192 pounds) containing 320 parts per million of dissolved aluminum was melted together with 90 pounds of lithium metal contaminated with lithium nitride (>300 ppm nitrogen). The melted metals were heated together at 250° C. for two hours with argon agitation after which precipitated aluminum nitride was separated from the lithium metal. The purified lithium contained less than 4 ppm nitrogen and less than 3 parts per million aluminum.

9. Lithium metal, 67 pounds containing 320 ppm of aluminum and 127 pounds of lithium containing 175 ppm aluminum, was melted together with 70.6 pounds of lithium metal contaminated with lithium nitride (>300 ppm nitrogen). The melted metals were heated together at 250° C. for two hours with argon agitation after which precipitated aluminum nitride was separated from the liquid lithium. After cooling, the purified lithium was found to contain 40 ppm nitrogen and less than 8 ppm aluminum.

10. Two lots of lithium metal, one of 201 pounds containing 170 ppm aluminum and the other, weighing 43 pounds and containing 320 ppm aluminum, were melted together with 43 pounds of lithium metal contaminated lithium nitride (>300 ppm nitrogen) for one hour at 250° C. with argon agitation. The aluminum nitride which precipitated was separated from the lithium metal. The purified lithium metal was found to contain less than twenty ppm nitrogen and ten ppm aluminum.

11. Two lots of lithium metal, one of 315 pounds containing 415 ppm nitrogen and the other, weighing 5.2 pounds and containing 3% by weight aluminum (97% Li), were melted together in a reactor for one hour at 250° C. with argon agitation. Aluminum nitride was separated from the lithium metal. The purified lithium was found to contain less than 100 ppm nitrogen and less than 10 ppm aluminum.

What we claim is:

1. A process for the removal of lithium nitride from a liquid lithium metal consisting essentially of adding to liquid lithium metal containing lithium nitride, in an inert, nitrogen free atmosphere at a temperature between the melting point of lithium and 300° C., a stoichiometric quantity of aluminum to react with the lithium nitride, with agitation performed by introducing an inert nitrogen free gas beneath the surface of the lithium, continuing the agitation for a period of time sufficient to form aluminum nitride and separating the aluminum nitride from the liquid lithium metal.

2. The process of claim 1 wherein the nitrogen free atmosphere is a rare gas, inert atmosphere.

3. The process of claim 1 wherein the aluminum is added in the form of a lithium-aluminum alloy.

4. The process of claim 2 wherein the rare gas is argon.

5. The process of claim 1 wherein the temperature is between 181° C. and 300° C., the nitrogen free atmosphere is provided by use of argon gas, the aluminum is introduced as a lithium-aluminum alloy and agitation is continued for at least one hour after the lithium-aluminum alloy is added to the liquid lithium.

6. The process of claim 1 wherein the agitation is conducted for one to twenty-four hours.

7. The process of claim 1 wherein the aluminum is added in the form of granular aluminum.

8. The process of claim 1 wherein the inert nitrogen free gas introduced below the surface of the lithium to provide agitation is argon.

* * * * *

TABLE 1

Summary of Test Results for Nitride Removal From Lithium Metal by Aluminum

| Expt # Cast # | Li Metal (lbs) | Al Added (g) | Temp. (°C.) | Stirring Time (h) | Settling Time (h) | N (ppm) | % N Removed | Al (ppm) | Ca (ppm) | Molar Ratio Al/N |
|---|---|---|---|---|---|---|---|---|---|---|
| 1 | 115 | — | — | — | — | 390 | — | — | — | — |
| 1-1 | — | 154.3 | 225 | 8 | 12 | 20 | 95 | — | — | 3.9 |
| 1-6 | | | | | | 10 | 97 | — | — | |
| 1-12 | | | | | | 10 | 97 | — | — | |
| | | | | | | | AVE = 96 | | | |
| 2 | 101 | — | — | — | — | 560 | — | — | — | — |
| 2-6 | — | 200.4 | 225 | 16 | 29 | 20 | 96 | — | — | 4.1 |
| 2-11 | | | | | | 40 | 93 | — | — | |
| 2-12 | | | | | | 40 | 93 | — | — | |
| | | | | | | | AVE = 94 | | | |
| 3 | 316 | — | — | — | — | 690 | — | — | — | — |
| 3-2 | | 191.8 | 225 | 24 | 24 | 50 | 93 | — | 64 | 1.0 |
| 3-30 | | | | | | 60 | 91 | — | 56 | |
| 3-58 | | | | | | 40 | 94 | — | 61 | |
| | | | | | | | AVE = 93 | | | |
| 4 | 173 | — | — | — | — | 510 | — | 6 | 110 | |
| 4-1 | | 41.3 | 245 | 24 | 24 | 240 | 53 | 7 | 60 | 0.54 |
| 4-2 | | | | | | 240 | 53 | 6 | 58 | |
| 4-4 | | | | | | 240 | 53 | 10 | 56 | |
| 4-9 | | | | | | 240 | 53 | 10 | 54 | |
| 4-12 | | | | | | 240 | 53 | 10 | 62 | |
| | | | | | | | AVE = 53 | | | |
| 5[a] | 173 | — | — | — | — | 510 | — | 6 | 110 | — |
| 5-1 | | 59.3 | 245 | 24 | 24 | 90 | 82 | 10 | 57 | 0.77 |
| 5-4 | | | | | | 160 | 68 | 10 | 56 | |
| 5-5 | | | | | | 170 | 67 | 10 | 57 | |
| 5-6 | | | | | | 170 | 67 | 6 | 55 | |
| 5-10 | | | | | | 150 | 71 | 7 | 55 | |
| 5-15 | | | | | | 169 | 68 | 7 | 55 | |
| 5-20 | | | | | | 180 | 65 | 7 | 57 | |
| | | | | | | | AVE = 70 | | | |
| 6 | 173 | — | — | — | — | 510 | — | 6 | 110 | — |
| 6-1 | | 83.1 | 245 | 24 | 24 | 30 | 94 | 9 | 46 | 1.1 |
| 6-5 | | | | | | 20 | 96 | 9 | 45 | |
| 6-10 | | | | | | 40 | 92 | 9 | 46 | |
| 6-15 | | | | | | 70 | 86 | 9 | 45 | |
| | | | | | | | AVE = 92 | | | |

[a]To the metal in Example 4 was added an additional 18 grams of aluminum and the results reported under Example 5. Another 23.8 grams of aluminum was added to Example 5 and the results reported under Example 6.